US006817867B1

(12) United States Patent
Carr et al.

(10) Patent No.: US 6,817,867 B1
(45) Date of Patent: Nov. 16, 2004

(54) CONNECTOR ARRANGEMENT FOR AN ELECTRIC BLANKET OR THE LIKE HAVING A LOW VOLTAGE POWER SUPPLY

(75) Inventors: Sheldon P. Carr, West Bend, WI (US); Richard Zimmerer, Charlotte, NC (US)

(73) Assignee: Perfect Fit Industries, Inc., Charlotte, NC (US)

( * ) Notice: Subject to any disclaimer, the term of this patent is extended or adjusted under 35 U.S.C. 154(b) by 0 days.

(21) Appl. No.: 10/438,577

(22) Filed: May 15, 2003

(51) Int. Cl.[7] ..... H01R 33/00
(52) U.S. Cl. ..... 439/37
(58) Field of Search ..... 439/37, 660, 352, 439/674, 677, 680, 682, 148, 732; 219/517

(56) References Cited

U.S. PATENT DOCUMENTS 2,317,189 A 4/1943 Heiser et al.
2,696,549 A 12/1954 Sturtevant
4,585,922 A 4/1986 Berenson
4,927,366 A * 5/1990 Tommerson et al. ..... 439/37

* cited by examiner

*Primary Examiner*—Tho D. Ta

(74) *Attorney, Agent, or Firm*—Boyle, Fredrickson, Newholm, Stein & Gratz, S.C.

(57) ABSTRACT

A heating arrangement includes a pliable member such as a blanket, mattress pad, throw, etc., having a heating element that is engageable with a power supply via a connection arrangement secured to the heating element and to the pliable member, and a connector from a power supply cord that extends from the power supply. The connection arrangement includes a housing within which the ends of the heating element are located, and a mounting member that surrounds the housing and is connected to the pliable member for maintaining the connection arrangement in place. The ends of the heating element include connector pins that are received within passages defined by the housing, and which are adapted for engagement by receivers associated with the power supply connector. A retainer arrangement is interposed between the power supply connector and the housing, for releasably maintaining the power supply connector in engagement with the housing. The housing includes a greater number of passages than connector pins, and the connector pins are engaged within the passages in a predetermined arrangement according to the parameters of the pliable member, e.g. size and desired heat output. The power supply connector of a compatible power supply includes a similar number of passages, and has receivers that are configured so as to correspond to the configuration of the heating element connector pins so as to ensure that the proper power supply is used for the pliable member.

21 Claims, 5 Drawing Sheets

CONNECTION PINS USED FOR PADS

| PADS | PIN #1 | PIN #2 | PIN #3 |
|---|---|---|---|
| TWIN | | ● | ● |
| FULL | ● | ● | |
| QUEEN | | ● | ● |
| KING | | ● | ● |
| CAL KING | | ● | ● |

FIG. 9

CONNECTION PINS USED FOR BLANKETS

| BLANKETS | PIN #1 | PIN #2 | PIN #3 |
|---|---|---|---|
| TWIN | ● | ● | |
| FULL | ● | | ● |
| QUEEN | ● | ● | |
| KING | ● | ● | |
| THROW | | ● | ● |

FIG. 10

CONNECTOR ARRANGEMENT FOR AN ELECTRIC BLANKET OR THE LIKE HAVING A LOW VOLTAGE POWER SUPPLY

BACKGROUND AND SUMMARY OF THE INVENTION

This invention relates to a heated pliable member such as an electric blanket, heating pad, mattress pad, etc., and more particularly to a connection arrangement for supplying power from a power supply to a wire-type heating element in the pliable member.

A heated pliable member, such as an electric blanket, heating pad, mattress pad or throw, includes a power supply that supplies electrical power to a resistive heating arrangement, such as one or more resistive heating wires, that are located throughout the area of the pliable member. A heated pliable member of this type is shown and described in copending application Ser. No. 10/269,189 filed Oct. 11, 2002, the disclosure of which is hereby incorporated by reference. The '189 application discloses a heated pliable member in which power is supplied to a heating wire from a low voltage power supply. A cord extends between the power supply and a connector associated with the pliable member, to provide power to the resistive heating wire of the pliable member.

It is an object of the present invention to provide a connection arrangement for engaging the cord of a power supply, and in particular a low voltage power supply, with the resistive heating element, such as a heating wire, provided in the pliable member. It is a further object of the invention to provide such a connection arrangement that reduces strain on the ends of the heating wire at the connection arrangement. Yet another object of the invention is to provide such a connection arrangement that incorporates a releasable engagement feature for securing a plug at the end of a power supply cord with the connection arrangement. A still further object of the invention is to provide such a connection arrangement that can be selectively configured for use with power supplies of different voltages while utilizing common components for the connection arrangement. A still further object of the invention is to provide such a connection arrangement which is relatively simple in its components, construction and assembly, so as to provide a relatively low cost of manufacture and assembly, while providing a reliable and secure connection of the power supply to the heating wire of the pliable member.

In accordance with one aspect of the present invention, a connection arrangement for a heated pliable member, which includes a heating element such as a resistive heating wire having a pair of ends, includes a pin member that is engaged with each end of the heating wire. The pin members are engaged within passages defined by a housing, via cooperating engagement structure associated with the housing passages and the pin members for maintaining the axial position of the pin members within the housing. The housing is engaged with a mounting member, which is secured to the pliable member such that an outer portion of the mounting member is exposed and an inner portion of the mounting member is located in the interior of the pliable member. The mounting member includes wings or tabs that arc stitched into the material of the pliable member so as to maintain the mounting member, and thereby the housing, in place relative to the pliable member. In one form, the mounting member is overmolded onto the housing, to maintain the housing and the mounting member together.

In accordance with another aspect of the invention, the housing includes an outer section that extends outwardly from the mounting member, and which is adapted to be engaged by a plug or connector member that is interconnected with the power supply cord, which in turn is connected at its opposite end to the power supply. The power supply connector member includes power supply receivers that are adapted to receive the pin members when the power supply connector member is engaged with the outer section of the housing, to supply power to the resistive heating wire from the power supply. A releasable engagement arrangement is interposed between the connector member and the outer section of the housing, for preventing inadvertent disengagement of the connector member from the housing. The releasable engagement arrangement may be in the form of a ramp member on an outer surface defined by the outer section of the housing, which is engaged by a movable locking member when the connector member is engaged with the outer section of the housing. The locking member is movable between an engaged position, in which the locking member engages the ramp member to prevent inadvertent removal of the connector member from the outer section of the housing, and a release position in which the locking member is disengaged from the ramp member so as to enable the plug member to be disengaged from the outer section of the housing.

In accordance with another aspect of the invention, the configuration of the connection arrangement can be altered according to the characteristics of different power supplies, e.g. that are used with different types of pliable members such as heating pads, blankets, throws, mattress pads, etc. The housing includes a greater number of passages than the number of pin members that are engaged with the housing. Representatively, in an arrangement in which a pair of pin members are engaged one with each end of the resistive heating wire, the housing includes three passages, each of which is adapted to receive one of the pin members. The pair of pin members are engaged within the three passages in one of a number of predetermined pin member configurations wherein two of the passages are occupied by pin members and the third passage is empty, to enable engagement with a plug member having a matching configuration according to the characteristics of the power supply, e.g. the power supply voltage, and the heating output, length, etc. of the heating element.

The aspects of the connection arrangement as summarized above may be used in combination to provide a connection arrangement having a number of features that cooperate to enhance construction, assembly and operation of the connection arrangement. Alternatively, the features as summarized above may be used individually or in various subcombinations, to provide a power supply connection arrangement having a desired construction and operation.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIGS. 9 and 10 are charts showing the wire connection configurations that can be incorporated in the connector of FIGS. 2 and 3 for use with different power supplies for different applications.

DETAILED DESCRIPTION OF THE INVENTION

Figure 1:
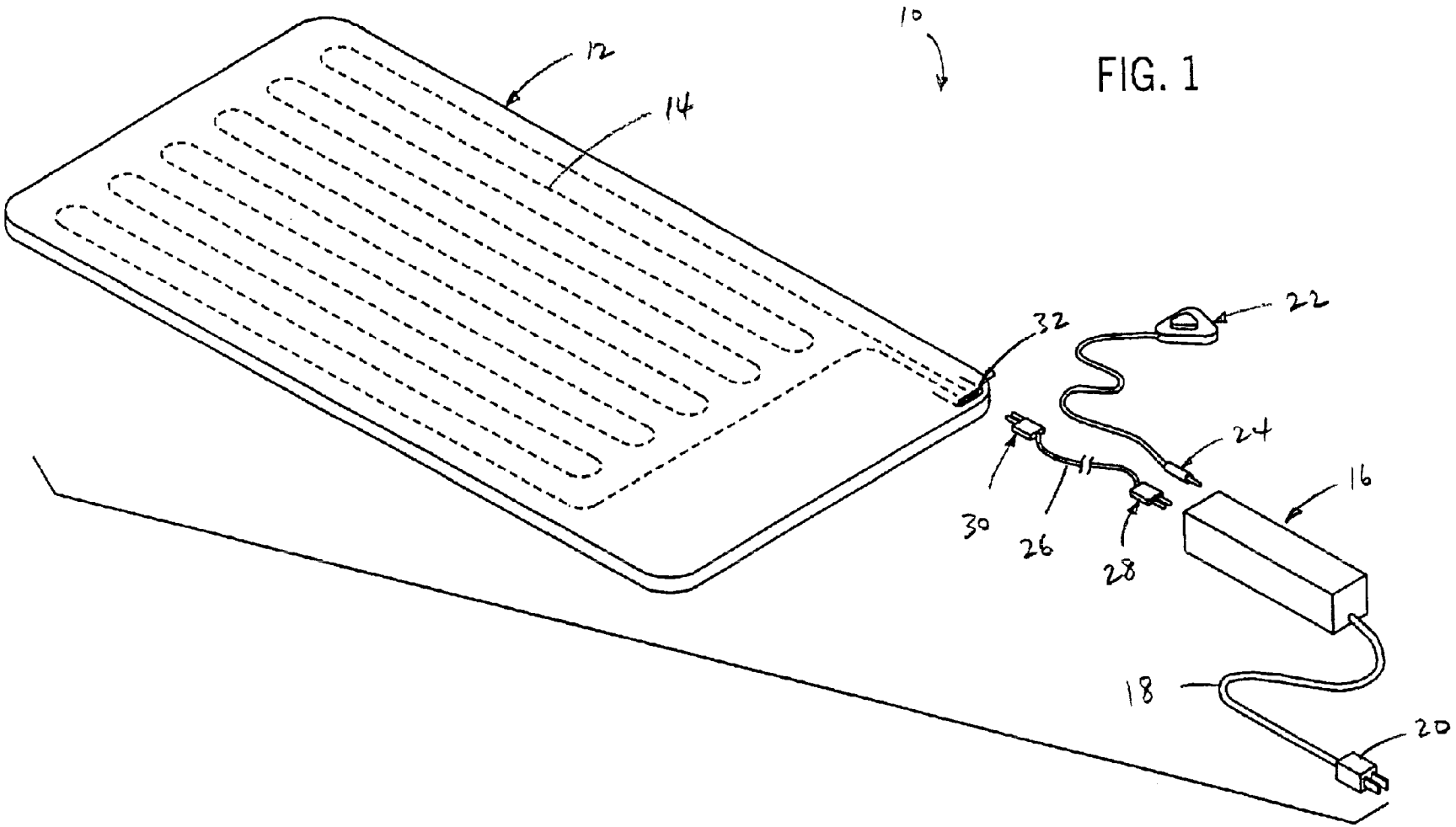
FIG. 1 is an isometric view illustrating a pliable heating member incorporating the connection arrangement of the present invention.

Referring to FIG. 1, a heating arrangement 10 generally includes a pliable member 12 having a wire-type resistive heating element 14. Pliable member 12 may be in the form of a heating pad, blanket, mattress pad, throw, etc., and preferably includes a pair of layers between which heating element 14 is located. Heating element 14 covers a majority of the area of pliable member 12, and radiates heat when electrical power is supplied to heating element 14.

Heating arrangement 10 further includes a power supply 16 that is adapted for engagement with an electrical outlet or other power supply receptacle via a cord 18 having a plug 20, in combination with a controller 22 that is engageable with power supply 16 via a connector 24. A power supply cord 26 is engageable with power supply 16 via a connector 28, and includes a connector 30 at the end opposite connector 28, which is engageable with a connection arrangement 32 so as to enable the supply of power from power supply 16 through cord 26 to heating element 14, in a manner to be explained.

Power supply 16 and controller 22 are shown and described in copending application Ser. No. 10/269,189 filed Oct. 11, 2002, the disclosure of which is hereby incorporated by reference. Generally, power supply 16 is responsive to operation of controller 22 so as to output low voltage electrical power, which is supplied to heating element 14 as described in the copending '189 application.

Figure 2:
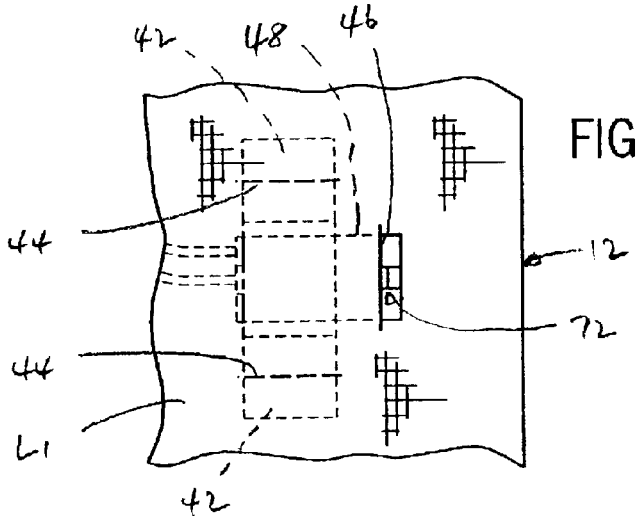
FIG. 2 is a partial top plan view showing a portion of the pliable member and a connector member forming a part of the connection arrangement of the present invention.
Figure 3:
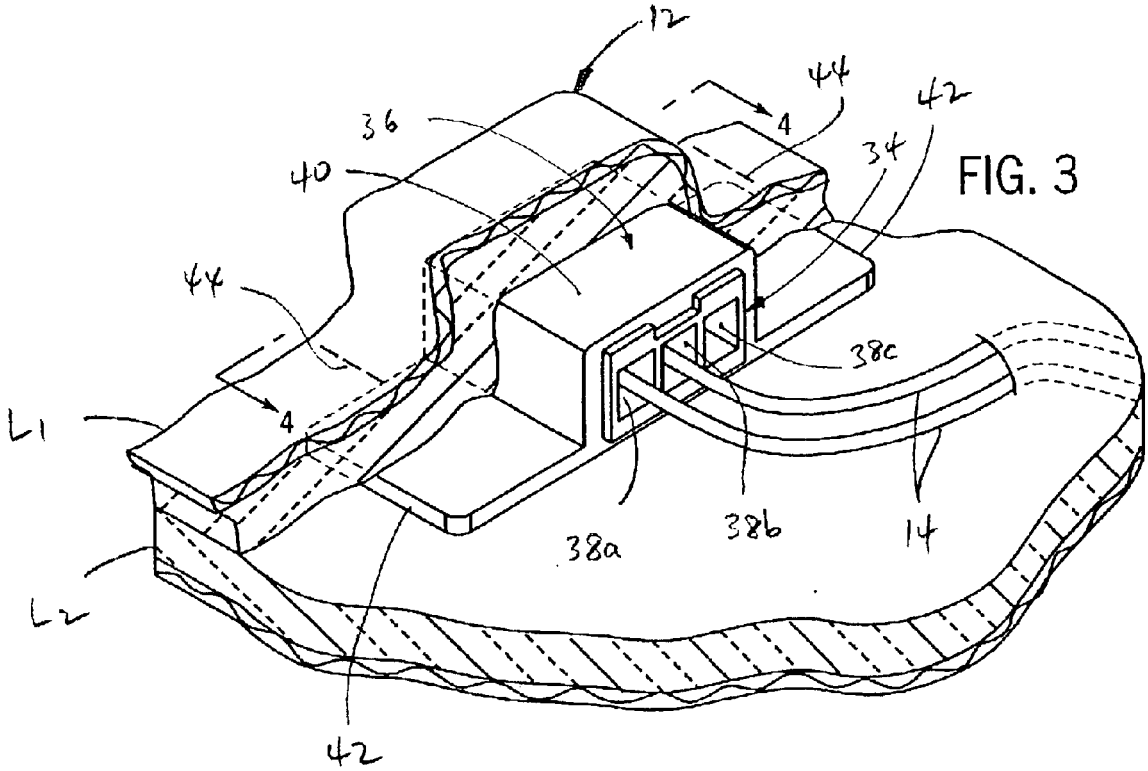
FIG. 3 is a partial isometric view showing the connector member of FIG. 2 and a portion of the pliable member to which the connector member is secured.

Referring to FIGS. 2 and 3, connection arrangement 32 generally includes a housing 34 and a mounting member 36. Housing 34 is preferably formed of a rigid thermoplastic material, and may be that such as is available from Molex, Inc. of Lisle, Ill. under its designation 50-29-0092. Housing 34 includes a series of passages 38*a*, 38*b* and 38*c*, which extend throughout the length of housing 34.

Mounting member 36 includes a tubular body 40 that surrounds an inner portion of housing 34, and a pair of wings or tabs 42 that extend outwardly in opposite directions from body 40. Tabs 42 are coplanar, and extend from a lower wall defined by body 40, below the area of body 40 within which housing 34 is received. Body 40 and tabs 42 are preferably formed of a pliable material, such as a soft rubber, and may be formed so as to be overmolded onto housing 34 so as to maintain housing 34 and mounting member 36 together. It is understood, however, that housing 34 and mounting member 36 may be interconnected together in any other satisfactory fashion.

Figure 4:
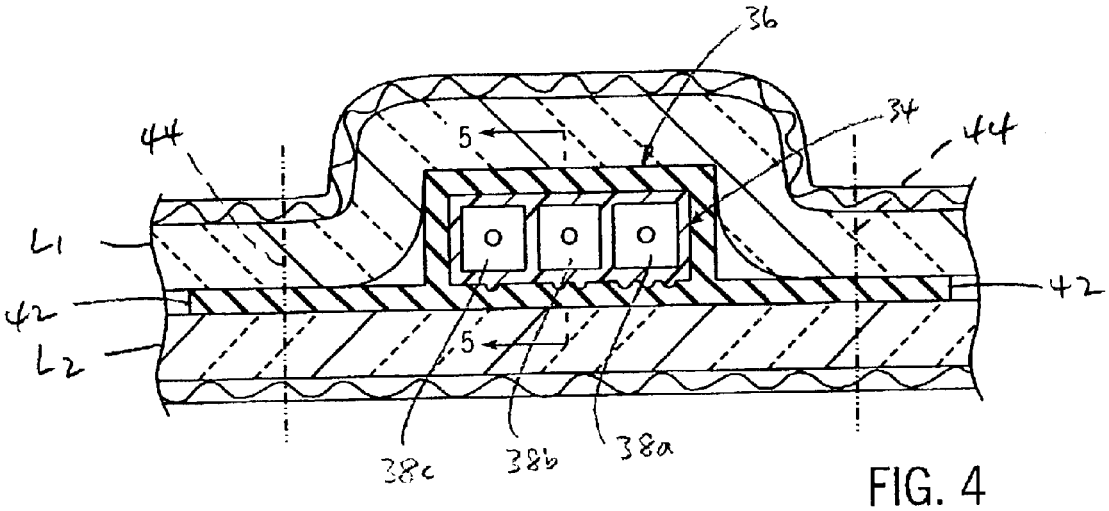
FIG. 4 is a partial section view taken along line 4—4 of FIG. 3.

Referring to FIGS. 3 and 4, pliable member 12 is preferably formed of at least two layers of material, shown in FIGS. 3 and 4 as L1 and L2, so as to define an internal area located between layers L1 and L2 within which mounting member 36 is located. Mounting member 36 is maintained in position relative to pliable member 12 via a line of stitches, shown at 44, that extend through layers L1 and L2 and through tabs 42, so as to sandwich tabs 42, 44 between layers L1 and L2 and to fix mounting member 36, and thereby housing 34, in position relative to pliable member 12.

An opening 46 is formed in layer L1 of pliable member 12. Housing 34 includes an outer portion 48 that extends from mounting member 36, the outer end of which extends through opening 46 so as to be accessible from the exterior of pliable member 12.

Figure 5:
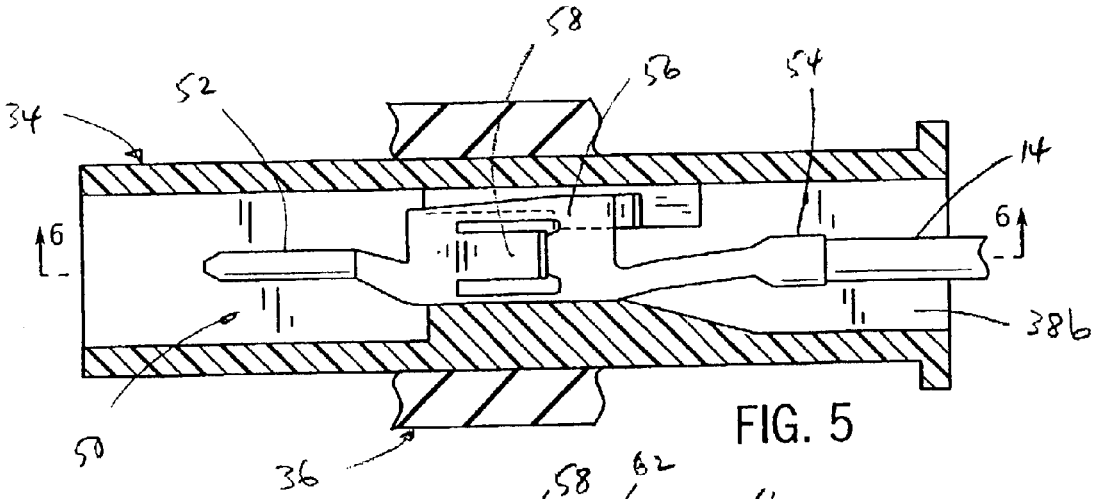
FIG. 5 is a partial section view taken along line 5—5 of FIG. 4.
Figure 6:
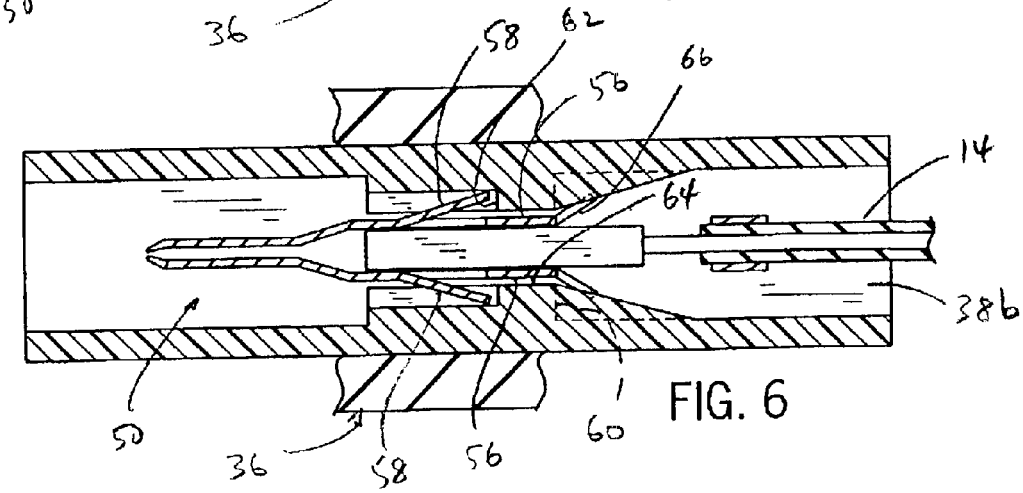
FIG. 6 is a partial section view taken along line 6—6 of FIG. 5.

Heating element 14 is in the form of a resistive wire having a pair of ends that are engaged with housing 34 via connector pins, such as shown in FIGS. 5 and 6 at 50. Each connector pin 50 is adapted for engagement within one of recesses 38*a*, 38*b*, 38*c*, for securing the end of heating element 14 to housing 34. The construction of connector pins 50 is known in the art, and a representative connector pin construction is available from Molex, Inc. of Lisle, Ill. under its Part No. 39-00-0048 (male) or 39-00-0038 (female). As shown in FIGS. 5 and 6, each connector pin 50 includes an outer engagement section 52 and a collar 54 that is engaged with the conductor of heating element 14. Engagement structure is located between collar 54 and outer engagement section 52, including a pair of side walls 56 having outwardly angled engagement wings 58. Each passage, such as passage 38*b*, includes a narrowed area configured to receive and engage the engagement structure of connector pin 50 between outer engagement section 52 and collar 54. The passage structure includes a rear shoulder 60 and a forward shoulder 62, located on opposite sides of a throat 64. With this construction, connector pin 50 is engaged within passage 38*b* in a push-in manner, in which wings 58 collapse during passage through throat 64 and thereafter expand outwardly to the position as shown in FIG. 6, to prevent retraction of connector pin 50. Rear wings 66 on side walls 56 prevent connector pin 50 from being pushed through throat 64, while engagement of the rear edges of forward wings 58 prevents connector pin 50 from being withdrawn from passage 38*b*. A connector pin such as 50 is engaged with each end of heating element 14, for mounting the ends of heating element 14 to housing 34.

Figure 7:
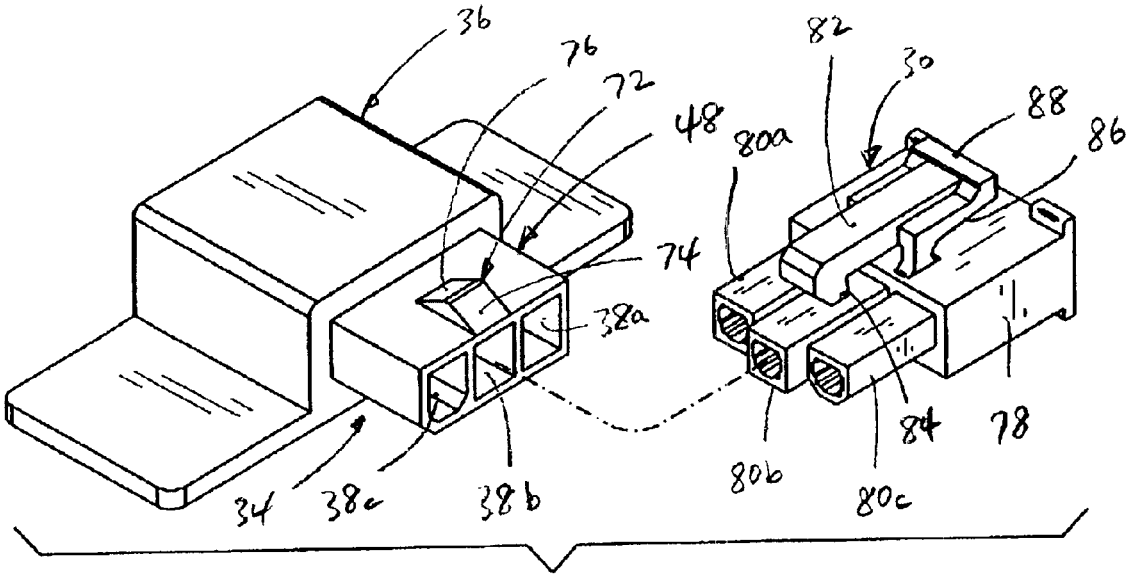
FIG. 7 is an isometric view showing the connector of FIGS. 2–4 in combination with a connector member that is interconnected with the power supply in the heating arrangement of FIG. 1, for providing electrical power to the heating element contained within the pliable member from the connector member.

As shown in FIGS. 2 and 7, outer portion 48 of housing 34 includes an engagement member 72, which is formed integrally with one of the walls of housing 34. Engagement member 72 includes a forward ramped surface 74 and a rear ramped surface 76, which cooperate to define an obtuse angle.

Referring to FIG. 7, connector 30 at the end of power supply cord 36 includes a body 78 and engagement members 80*a*, 80*b* and 80*c*, that are configured to be received within passages 38*a*, 38*b* and 38*c*, respectively, of housing 34. To ensure proper orientation of connector 30 relative to housing 34, one of the passages in housing 34, such as passage 38*c*, is configured differently than the others and the corresponding engagement member of connector 30, such as engagement member 80*c*, has a matching configuration. In the illustrated embodiment, passage 38*c* has oblique edges and engagement member 80*c* has a cross section that matches that of passage 38*c*. In this manner, connector 30 can only be engaged with housing 34 in one orientation.

Connector 30 includes a frictional engagement member, in the form of a biased engagement arm 82 having a depending tab 84, which is engageable with engagement member 72 so as to releasably maintain connector 30 in engagement with outer portion 48 of housing 34. At its end, arm 82 is connected between a pair of mounting brackets 86 via a cross member 88, which is secured to the end of arm 82 and extends between mounting brackets 86. Mounting brackets 86 and cross member 88 are configured to bias arm 82 toward an engaged position, as shown in FIGS. 7 and 8.

Engagement members 80, 80*a*, 80*b* and 80*c* define passages within which receivers are located, which are configured to receive the engagement section 52 of one of connector pins 50, in a known manner. The placement of the receivers within the passages of engagement members 80*a*, 80*b* and 80*c* corresponds to the placement of connector pins 50 within passages 38*a*, 38*b* and 38*c*, to establish an electrical connection of power supply 16 to heating element 14 through cord 26, connector 30 and connection arrangement 32. Connector 30 is shown in engagement with housing 34 of connection arrangement 32 in FIG. 8, in which engagement members 80*a*, 80*b* and 80*c* are received within passages 38*a*, 38*b*, 38*c*, respectively, of housing 34 of connection arrangement 32, and engagement sections 52 of connector pins 50 are received within the receiver members in the appropriate ones of engagement members 80*a*, 80*b* and 80*c*.

Figure 8:
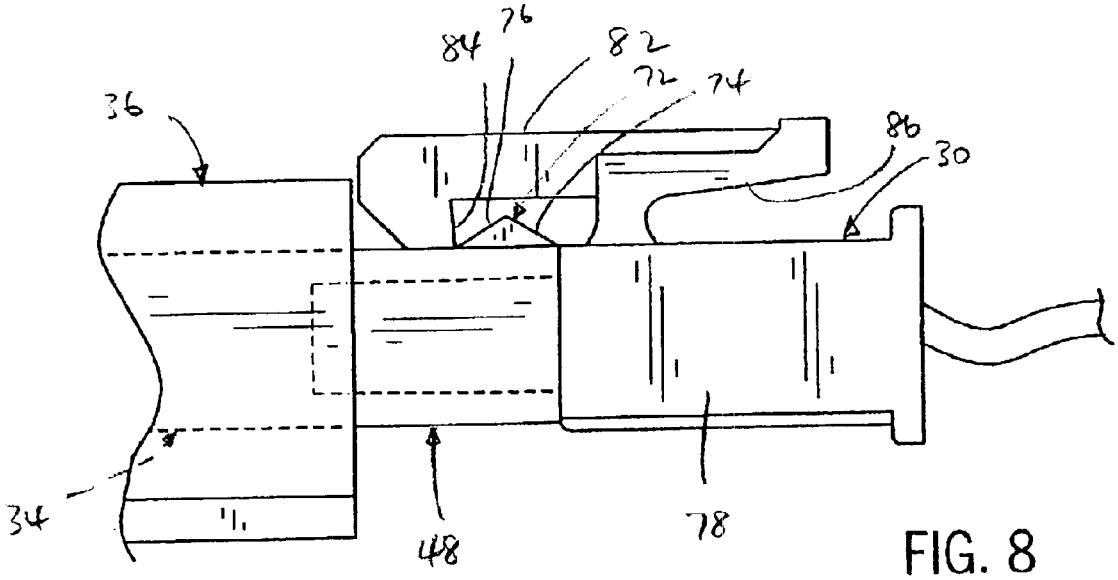
FIG. 8 is a side elevation view showing the connectors of FIG. 7 in engagement with each other.

During engagement of connector 30 with outer portion 48 of housing 34, tab 84 of arm 82 engages forward ramp surface 74 of engagement member 72, and rides along ramp surface 74 over the upper extent of engagement member 72 and then downwardly along rear ramp surface 76 so as to attain the position of FIG. 8. Such positioning of tab 84 rearwardly of rear ramp surface 76 functions to provide a frictional connection of connector 30 to housing 34, so as to maintain connector 30 in engagement with housing 34 and to prevent inadvertent disengagement of connector 30. To disengage connector 30, the user applies an axial outward force on connector 30 and connection arrangement 32 so as to separate connector 30 from housing 34, which causes tab 84 to ride along rear ramp surface 76 and then forward ramp surface 74. Cross member 88, which applies a downward bias on arm 82, enables arm 82 to pivot upwardly during such movement of connector 30, and to thereafter return to its original position.

The same sequence of events occurs when a sudden axial force is applied, either to connector 30 or to cord 26, that tends to separate connector 30 from housing 34. In this manner, the ability of connector 30 to be disengaged from housing 34 prevents damage to either pliable member 12 or to heating element 14, which may otherwise occur if connector 30 and housing 34 were interconnected via a structure locking such components together.

The present invention contemplates an arrangement that ensures that pliable member 12 can only be engaged with a power supply having parameters, e.g. voltage, that are compatible with the pliable member. To accomplish this, connector pins 50 at the ends of heating element 14 are engaged within a selected two of passages 38*a*, 38*b* and 38*c*, while the remaining one of the passages is left empty. The receivers in connector 30 are arranged similarly in the passages of engagement members 80*a*, 80*b* and 80*c*, to ensure that power supply 16 can only be electrically connected to a pliable member 14 that is designed to be powered by the power supply 16. FIGS. 9 and 10 illustrate the pin configurations for the different types of pliable members, such as mattress pad and blanket products, that can incorporate a heating element 14 for connection to a power supply 16. Different power supplies 16 are used for the different products, and provide different voltage levels according to the characteristics and parameters of the pliable member that is being heated. The power supply connectors 28 and 30 have pin and receiver configurations as set forth in FIGS. 9 and 10, which match the arrangement of connector pins 50 in the passages of housing 34 and the receivers in the passages of engagement members 80*a*, 80*b* and 80*c*. In this manner, while any power supply connector 30 can be engaged with any housing 34, an electrical connection between power supply 16 and heating element 14 is only provided when the configuration of connector pins 50 in housing 34 matches the configuration of the receiver members in the passages of engagement members 80*a*, 80*b* and 80*c*, to ensure that an appropriate power supply 16 is being used with an appropriate pliable member 14.

Various alternatives and embodiments are contemplated as being within the scope of the following claims particularly pointing out and distinctly claiming the subject matter regarded as the invention.

We claim:

1. A heating arrangement, comprising:

a pliable member;

a wire-type heating element in the pliable member, wherein the wire-type heating element defines a pair of ends;

a connector secured to each end of the heating element;

a housing including a plurality of passages, wherein each connector is engaged within one of the plurality of passages; and a mounting member secured to the pliable member, wherein the mounting member defines an interior and wherein the housing is located in the interior of the mounting member and is engaged with the mounting member;

wherein a power supply member is engageable with the housing and includes a pair of power supply connectors that are configured for engagement with the connectors secured to the ends of the heating element.

2. The heating arrangement of claim 1, wherein the power supply member has power supply connectors in different configurations according to the characteristics of the power supply, and wherein the connectors are engaged within the passages of the housing to match the configuration of the power supply connectors of the power supply member.

3. The heating arrangement of claim 2, wherein the housing includes at least three passages and wherein the wire-type heating element comprises a wire member defining the pair of ends, wherein a pair of connectors are secured one to each end of the wire member, and wherein the connectors are engaged within the passages such that a pair of passages are occupied by the connectors and one of the passages is empty, wherein the arrangement of the connectors and the empty passage is selected according to the characteristics of the power supply and the power supply member.

4. A heating arrangement, comprising:

a pliable member;

a wire-type heating element in the pliable member, wherein the wire-type heating element defines a pair of ends;

a connector secured to each end of the heating element;

a housing including a plurality of passages, wherein each connector is engaged within one of the plurality of passages; and a mounting member secured to the pliable member, wherein the housing is engaged with the mounting member;

wherein a power supply member is engageable with the housing and includes a pair of power supply connectors that are configured for engagement with the connectors secured to the ends of the heating element; and wherein the mounting member defines an interior within which the housing is located, and includes outwardly extending tab structure that is engaged with the pliable member so as to maintain the mounting member in position relative to the pliable member.

5. The heating arrangement of claim 4, wherein the mounting member is overmolded onto the housing.

6. The heating arrangement of claim 4, wherein the pliable member defines an interior and includes an opening providing access to the interior, wherein the housing is located in the opening and defines an inner portion located in the interior of the pliable member and an outer portion that is exposed to the exterior of the pliable member.

7. The heating arrangement of claim 6, wherein the housing includes an outer section that extends outwardly from the mounting member, wherein the power supply member includes a recess within which the outer portion of the housing is received.

8. The heating arrangement of claim 7, wherein the power supply member and the outer section of the housing include a releasable engagement arrangement for selectively maintaining the power supply member in engagement with the outer section of the housing.

9. The heating arrangement of claim 8, wherein the releasable engagement arrangement comprises a ramp member on the outer section of the housing, wherein the ramp member defines an engagement surface, and wherein the power supply member includes a movable locking member that is movable between an engaged position in which the locking member engages the engagement surface of the ramp to maintain the power supply member in engagement with the outer section of the housing, and a release position in which the locking member is disengaged from the engagement surface of the ramp to enable the power supply member to be disengaged from the outer section of the housing.

10. A heating arrangement, comprising;

a pliable member;

an electrical heating arrangement associated with the pliable member, wherein the electrical heating arrangement includes a wire-type heating member defining a pair of ends;

an electrical connection arrangement including a housing within which the ends of the wire-type heating member are located, and a mounting member defining an interior, wherein the housing is located within the interior of the mounting member and is engaged with the mounting member, and wherein the mounting member is secured to the pliable member;

a power supply for supplying electrical power to the electrical heating arrangement, including a power supply member, wherein the power supply member is releasably engageable with the electrical connection arrangement; and a releasable engagement arrangement associated with the power supply member and the electrical connection arrangement, wherein the releasable engagement arrangement is configured to selectively maintain the power supply member in engagement with the electrical connection arrangement.

11. The heating arrangement of claim 10, wherein the power supply member is configured for engagement with the housing of the electrical connection arrangement and wherein the releasable engagement arrangement is interposed between the power supply member and the housing.

12. The heating arrangement of claim 11, wherein the pair of ends of the wire-type heating member are interconnected with pin members engaged within passages defined by the housing, wherein the power supply member of the power supply arrangement is configured for engagement with the pin members when the power supply member is engaged with the housing of the electrical connection arrangement for establishing an electrical connection of the power supply arrangement with the wire-type heating member.

13. A heating arrangement, comprising:

a pliable member;

an electrical heating arrangement associated with the pliable member, wherein the electrical heating arrangement includes an electrical connection arrangement;

a power supply for supplying electrical power to the electrical heating arrangement, including a power supply member, wherein the power supply member is releasably engageable with the electrical connection arrangement; and a releasable engagement arrangement associated with the power supply member and the electrical connection arrangement, wherein the releasable engagement arrangement is configured to selectively maintain the power supply member in engagement with the electrical connection arrangement;

wherein the electrical heating arrangement comprises a wire-type heating member defining a pair of ends, and wherein the connection arrangement includes a housing within which the ends of the wire-type heating member are located, and a mounting member with which the housing is engaged wherein the mounting member is secured to the pliable member; and wherein the housing includes an outer portion that extends outwardly from the mounting member exteriorly of the pliable member, and wherein the releasable engagement arrangement comprises cooperating engagement structure on the power supply member and the outer portion of the housing for selectively maintaining the power supply member in engagement with the housing.

14. The heating arrangement of claim 13, wherein the cooperating engagement structure comprises a ramp member on the outer portion of the housing, wherein the ramp member defines an engagement surface, and a movable retainer member on the power supply member, wherein the movable retainer member is movable between an engaged position in which the movable retainer member is engaged with the engagement surface of the ramp member to maintain the power supply member in engagement with the outer portion of the housing, and a disengaged position in which the movable retainer member is disengaged from the engagement surface of the ramp member to enable the power supply member to be moved out of engagement with the outer portion of the housing.

15. A heating arrangement, comprising:

a pliable member;

an electrical heating arrangement associated with the pliable member, wherein the electrical heating arrangement includes a connection arrangement interconnected with the pliable member; and a power supply including a power supply member engageable with the connection arrangement;

wherein the power supply member and the electrical heating arrangement include unique engagement structure to prevent connection of the electrical heating arrangement with an incompatible power supply and vice versa, wherein the power supply member and the connection arrangement include cooperating structure for providing engagement of the power supply member and the connection arrangement in a predetermined orientation;

wherein one of the power supply member and the connection arrangement includes a number of passages and the other of the power supply member and the connection arrangement includes a number of engagement members, each of which is configured for engagement within one of the passages, and wherein the unique engagement structure comprises a number of first connectors in the connection arrangement interconnected with the electrical heating arrangement and engaged with the connection arrangement in a predetermined configuration, and a number of second connectors interconnected with the power supply and engaged with the power supply member in a predetermined configuration that corresponds to the configuration of the number of first connectors; and wherein the connection arrangement includes a number of first passages within which the first connectors are located, wherein there is a greater number of first passages than first connectors that are engaged with the electrical heating arrangement to define at least one empty first passage, and wherein the power supply member includes a number of second passages within which the second connectors are located, wherein there is a greater number of second passages than second connectors that are interconnected with the power supply to define at least one empty second passage, wherein the location of the empty first passage corresponds to the location of the empty second passage when the power supply and the electrical heating arrangement are compatible;

wherein the power supply member has second connectors in different configurations according to the characteristics of the power supply, and wherein the first connectors are located within the passages of the connection arrangement so as to match the configuration of the second connectors of the power supply member.

16. The heating arrangement of claim 15, further comprising releasable engagement structure interconnected with the connection arrangement and the power supply member to releasably maintain the power supply member in engagement with the connection arrangement.

17. A heating arrangement comprising:

a pliable member;

an electrical heating arrangement associated with the pliable member, wherein the electrical heating arrangement includes a connection arrangement interconnected with the pliable member, wherein the connection arrangement includes a housing member and wherein the electrical heating arrangement includes a heating wire member defining ends that are engaged with the housing member; and a power supply including a power supply member engageable with the housing member of the connection arrangement;

wherein the power supply member and the electrical heating arrangement include unique engagement structure to prevent connection of the electrical heating arrangement with an incompatible power supply and vice versa, and wherein the power supply member and the connection arrangement include cooperating structure for providing engagement of the power supply member and the connection arrangement in a predetermined orientation; and a mounting member defining an interior, wherein located within the interior of the mounting member and is engaged with the mounting member, wherein the mounting member is engaged with the pliable member to maintain the housing member in a predetermined position relative to the pliable member.

18. The heating arrangement of claim 17, wherein one of the power supply member and the housing includes a number of passages and the other of the power supply member and the housing includes a number of engagement members, each of which is configured for engagement within one of the passages, and wherein the unique engagement structure comprises a number of first connectors in the housing interconnected with the electrical heating arrangement and engaged with the housing in a predetermined configuration, and a number of second connectors interconnected with the power supply and engaged with the power supply member in a predetermined configuration that corresponds to the configuration of the number of first connectors.

19. A method of interconnecting a power supply to a connection arrangement connected to a heating element in a pliable member, comprising the steps of:

providing the connection arrangement with a number of passages;

engaging at least two connectors with the heating element and securing the at least two connectors within at least two of the passages in the connection arrangement, wherein at least one of the passages does not have a connector interconnected with the heating element; and engaging a power supply member with the connection arrangement, wherein the power supply member includes connection structure configured for engagement with the connection arrangement, and further includes at least two power supply connectors that are in locations corresponding to the locations of the at least two connectors of the connection arrangement;

wherein the power supply member has power supply connectors in different configurations according to the characteristics of the power supply, and wherein the step of securing the at least two connectors within the passages of the connection arrangement is carried out so as to match the configuration of the power supply connectors of the power supply member.

20. The method of claim 19, wherein the step of engaging the power supply member with the connection arrangement is carried out by engaging the power supply member with the connection arrangement in a predetermined orientation via cooperating engagement structure provided on both the connection arrangement and the power supply member.

21. The method of claim 20, wherein the step of engaging at least two connectors within at least two of the passages in the connection arrangement is carried out such that the two connectors are arranged according to a predetermined configuration corresponding to the parameters of a power supply that is compatible with the heating element in the pliable member.

* * * * *